US006054042A

United States Patent [19]

Gorbaty et al.

[11] Patent Number: 6,054,042

[45] Date of Patent: Apr. 25, 2000

[54] PROCESS FOR NEUTRALIZATION OF PETROLEUM ACIDS USING OVERBASED DETERGENTS

[75] Inventors: Martin L. Gorbaty, Westfield; David J. Martella, Princeton; Guido Sartori, Annandale; David William Savage, Lebanon; Bruce Henry Ballinger, Bloomsbury; Saul Charles Blum, Edison; Michael Paul Anderson, Clinton; Trikur Anantharaman Ramanarayanan, Somerset, all of N.J.

[73] Assignee: Exxon Research and Engineering Co., Florham Park, N.J.

[21] Appl. No.: 09/000,423

[22] PCT Filed: Aug. 23, 1996

[86] PCT No.: PCT/US96/13689

§ 371 Date: Aug. 3, 1998

§ 102(e) Date: Aug. 3, 1998

[87] PCT Pub. No.: WO97/08275

PCT Pub. Date: Mar. 6, 1997

Related U.S. Application Data

[63] Continuation-in-part of application No. 08/519,279, Aug. 25, 1995, abandoned.

[51] Int. Cl.[7] ..... C10Q 17/00

[52] U.S. Cl. ..... 208/263

[58] Field of Search ..... 208/263, 47, 347

[56] References Cited

U.S. PATENT DOCUMENTS

| | | | |
|---|---|---|---|
| 4,057,504 | 11/1977 | Shiga et al. | 252/33 |
| 4,100,082 | 7/1978 | Carson et al. | 208/19 |
| 4,199,440 | 4/1980 | Verchtert | 208/203 |
| 4,300,995 | 11/1981 | Liotta | 208/8 |
| 4,387,033 | 6/1983 | Lenack | 252/18 |
| 4,614,602 | 9/1986 | Vacho et al. | 252/33.3 |
| 5,182,013 | 1/1993 | Peterson et al. | 208/347 |
| 5,252,254 | 10/1993 | Babian-Kibala | 208/263 |

*Primary Examiner*—Helane Myers
*Attorney, Agent, or Firm*—Linda M. Scuorzo

[57] ABSTRACT

The invention relates to a process for treating naphthenic acid containing whole crudes or fraction thereof to reduce or eliminate their acidity by contacting the acidic whole crude or fractions thereof at a suitable temperature typically of less than 200° C. with a neutralizing amount typically from 0.25:1 up to 10:1 of overbased detergent. The process has the additional benefits of reducing materials handling problems associated with emulsion formation in treated crudes.

16 Claims, No Drawings

PROCESS FOR NEUTRALIZATION OF PETROLEUM ACIDS USING OVERBASED DETERGENTS

This is a continuation-in-part of U.S. Ser. No. 519,279 filed Aug. 25, 1995, abandoned and also a 371 of PCT/US96/13689 filed Aug. 23, 1996.

FIELD OF THE INVENTION

The present invention relates to a process for neutralizing petroleum acids in order to lower their corrosivity and increase their value.

BACKGROUND OF THE INVENTION

Whole crudes with high petroleum acid content such as those containing naphthenic acids are corrosive to the equipment used to extract, transport and process the crudes.

Efforts to minimize naphthenic acid corrosion have included a number of approaches. U.S. Pat. No. 5,182,013 refers to such recognized approaches as blending of higher naphthenic acid content oils with low naphthenic acid content oils. Additionally, a variety of attempts have been made to address the problem by using corrosion inhibitors for the metal surfaces of equipment exposed to the acids, or by neutralizing and removing the acids from the oil. Examples of these technologies include treatment of metal surfaces with corrosion inhibitors such as polysulfides (U.S. Pat. No. 5,182,013) or oil soluble reaction products of an alkynediol and a polyalkene polyamine (U.S. Pat. No. 4,647,366), or by treatment of a liquid hydrocarbon with a dilute aqueous alkaline solution, specifically dilute aqueous NaOH or KOH (U.S. Pat. No. 4,199,440). U.S. Pat. No. 4,199,440 notes, however, that a problem arises with the use of aqueous solutions that contain higher concentrations of base. These solutions form emulsions with the oil, necessitating use of only dilute aqueous base solutions. U.S. Pat. No. 4,300,995 discloses the treatment of carbonous materials particularly coal and its products such as coal liquids, vacuum gas oils, and petroleum residua having acidic functionalities, with a dilute quaternary base such as tetramethylammonium hydroxide in a liquid (alcohol or water).

While these processes have achieved varying degrees of success there is a continuing need to develop more efficient methods for treating these acidic crudes, whole crudes and fractions thereof.

SUMMARY OF THE INVENTION

The present invention provides for a process for decreasing the acidity of an acidic crude oil comprising: contacting a naphthenic acid-containing crude oil at an elevated temperature with an effective amount of overbased detergent dispersed in oil to produce a treated crude oil having a reduced acidity. Preferably the overbased detergent is a calcium sulfonate or phenate. The amount of overbased detergent should be effective to decrease the acidity of the crude and preferably can range from 0.025:1 to 10:1 moles of calcium to acidic functionality in the crude oil.

The present invention may suitably comprise, consist or consist essentially of the elements disclosed and may be practiced in the absence of an element not disclosed.

DETAILED DESCRIPTION OF THE INVENTION

Some whole crude oils and fractions thereof contain organic acids that contribute to corrosion or fouling of refinery equipment. These organic acids generally fall within the category of naphthenic and other organic acids. Naphthenic acids alone or in combination with other organic acids such as phenols can cause corrosion at temperature ranges of about 65° C. (150° F.) to 420° C. (790° F.).

The crudes that may be used are naphthenic acid-containing crude oils or acid-containing fractions thereof including whole and topped crudes, that are liquid or liquefiable at the temperatures at which the present invention is carried out. Whole crudes are unrefined, undistilled crudes.

Applicants have discovered that acidic crudes, i.e., those containing naphthenic acids may be treated by contacting the crude with an effective amount of an oil (hydrocarbon) dispersible basic reagent to produce a treated or final crude having a reduced or essential absence of acidity. This is accomplished by neutralizing in whole or in part the acidity of the crude. The naphthenic acids may be present either alone or in combination with other organic acids, such as phenols. The oil-dispersible basic reagents are called overbased detergents and are further described below. The acidic crudes are preferably whole crudes. However, acidic fractions of whole crudes, such as topped crudes, $500^{+\circ}$ F. ($260^{+\circ}$ C.), $650^{+\circ}$ F. ($343^{+\circ}$ C.) fractions, vacuum gas oils and $1050^{+\circ}$ F. ($565^{+\circ}$ C.) fractions also may be treated.

An additional benefit is the absence or substantial absence of emulsion formation. Emulsion formation is an undesirable and a particular problem that is encountered during treatment of naphthenic acid-containing crudes with aqueous bases. The formation of a crude oil-aqueous emulsion tends to interfere with the efficient separation of the crude oil and water phases and thus with recovery of the crude oil. Thus, in addition to their corrosivity, naphthenic acids must be removed from the crude oil due to their tendency to encourage emulsion formation during processing.

The term stoichiometric amount means a sufficient amount of overbased detergent on a moles basis to neutralize a mole of acidic functionality in the crude oil. For example, in the case of calcium overbased detergent the ratio is 0.5:1 moles of calcium to acid content in the starting crude. The terms "above", "greater than" or "in excess of stoichiometric, and the term "substoichiometric" and "less than stoichiometric" are defined in relation to the foregoing and will vary according to the valence of the metal cation.

The contacting is typically carried out at an elevated temperature sufficient to reflux the solution. Typically, this is less than 200° C., preferably from 20° C. to 200° C., however, temperatures of from about 100° C. to 170° C. also may be used. Desirably this results in neutralization of the naphthenic acids in the crude oil.

The oil dispersible basic reagents (overbased detergents) may be purchased commercially or synthesized using known procedures. Preferred in this invention are the overbased sulfonate and phenate detergents prepared from calcium, and those containing at least 3 wt % calcium are most preferred.

The overbased detergent is added to the acidic crude in an amount effective to produce a neutralized (fully or partially, as desired) final crude oil, i.e., a crude having a decreased acidity from the starting crude. Broadly, ratios ranging in effective amounts of from 0.025 moles to 10:1 moles, or 0.25 to 10:1, or 0.025 to 5:1, and 0.5:1 to 5:1 may be used. Thus, stoichiometric amounts of calcium to acidic functionality in the crude to higher mole ratios of overbased detergent to total acid of from 1:1 to about 10:1, preferably of from 2:1 to 1:1, to lower ratios, e.g., substoichiometric amounts, such as 0.025:1 moles up to a stoichiometric amount, preferably 0.25:1 moles up to a stoichiometric amount, as effective, may be used to achieve suitable levels of acid decrease. The addition of smaller (than stoichiometric) amounts of overbased detergent may result in an incomplete (i.e., partial neutralization) neutralization of the starting crude.

Reaction times depend on the temperature and the nature of the crude to be treated, its acid content, and the amount and type of overbased calcium phenate or sulfonate detergent added, but typically may be carried out for from less than about 1 hour to about 20 hours to produce a product having a decrease in naphthenic acid and other acid content.

The concentration of acid in the crude oil is typically expressed as an acid neutralization number or acid number, which is the number of milligrams of KOH required to neutralize the acidity of one gram of oil. It may be determined according to ASTM D-664. Typically, the decrease in acid content may be determined by a decrease in the neutralization number or intensity of the carboxyl band in the infrared spectrum at about 1708 $cm^{-1}$. Crude oils with total acid numbers (TAN) of about 1.0 and lower are considered to be of moderate to low corrosivity (crudes with a total acid number of 0.2 or less generally are considered to be of low corrosivity). Crudes with total acid numbers greater than 1.5 are considered corrosive. Acidic crudes having free carboxyl groups may be effectively treated using the process of the present invention. The IR analysis is particularly useful in cases in which a decrease in neutralization number is not evident upon treatment with the base a sufficient measure of acidity, as has been found to occur upon treatment with bases weaker than KOH.

While not wishing to be bound by any theory it is believed that the reaction takes place by neutralization of the acid groups on the naphthenic acid in the presence of inverse micelles of calcium carbonate dispersed in oil.

Whole crude oils are very complex mixtures in which a large number of competing reactions may occur. Unexpectedly, the reaction occurs although the acid is dilute in comparison to the large excess of crude and other reactive species typically present.

The process of the present invention has utility in processes in which inhibiting or controlling liquid phase corrosion, e.g., of metal surfaces, is important. More generally, the present invention may be used in applications in which a reduction in the acidity, typically, as evidenced by a decrease in the neutralization number of the acidic crude or a decrease in intensity of the carboxyl band in the infrared spectrum at about 1708 $cm^{-1}$ of the treated (neutralized) crude, would be beneficial and in which oil-aqueous emulsion formation is not desirable. The present invention also provides a method for controlling emulsion formation in acidic crudes, by treating a major contributing component of such emulsions, naphthenic and similar organic acids.

The present invention may be demonstrated with reference to the following non-limiting examples.

EXAMPLE 1

The reaction apparatus was a flask equipped with stirrer, and reflux condenser, immersed in an oil bath. 50 g of San Joaquin Valley crude, having a neutralzation number of 4.17 mg KOH/g was put into the flask. Then 1.8 g of an overbased calcium detergent dispersion in oil, having a base content equivalent to 135 mg KOH/g were added. The mixture was stirred at 100° C. for 8 hours, then cooled. The treated liquid had a neutralization number of 3.51 mg KOH/g. That corresponded to 83% of the original acidity still present. However, examination by infrared spectroscopy showed that the band at 1708 $cm^{-1}$, corresponding to the carboxyl group, had an intensity corresponding to only 26% of that of the untreated crude.

EXAMPLE 2

The reaction apparatus was the same as in Example 1. 50 g of the same crude used in Example 1 was put into the flask. 0.96 g of an overbased calcium sulfonate detergent dispersion in oil, having a base content equivalent to 252 mg KOH/g, was added. The mixture was stirred at 100° C. for 8 hours. The neutralization number had dropped to 2.84 mg KOH/g.

EXAMPLE 3

The reaction apparatus was the same as in Example 1. 50 g of the same crude used in Example 1 was put into the flask. 0.61 g of an overbased calcium sulfonate detergent dispersed in oil and having a base number equivalent to 400 mg KOH/g was added. The mixture was heated at 100° C. for 8 hours. The liquid had a neutralization number of 3.20 mg KOH/g. That corresponded to 76% of the original acidity. However, examination by infrared spectroscopy showed that the band at 1708 $cm^{-1}$, corresponding to the carboxyl group, had an intensity corresponding to only 26% of that of the untreated crude.

EXAMPLE 4

The reaction apparatus was the same as in Example 1. 50 g of the same crude used in Example 1 was put into the flask, followed by 2.5 g of the overbased detergent used in Example 2. The mixture was stirred at 100° C. for 8 hours. The liquid had a neutralization number of 2.79 mg KOH/g. That corresponded to 67% of the original acidity. However, examination by infrared spectroscopy showed that the band at 1708 $cm^{-1}$, corresponding to the carboxyl group, had an intensity corresponding to only 9% of that of the untreated crude.

EXAMPLE 5

The reaction apparatus was the same as in Example 1. 50 g of the same crude used in Example 1 were put into the flask, followed by 9.6 g of the overbased reagent used in Example 2. The mixture was stirred at 100° C. for 6 hours. The liquid had a neutralization number of 2.45 mg KOH/g . That corresponded to 58% of the original acidity. However, examination by infrared spectroscopy showed that the band at 1708 $cm^{-1}$, corresponding to the carboxyl group, had virtually disappeared.

We claim:

1. A method for decreasing the acidity of an acid-containing crude oil comprising: contacting a starting naphthenic acid-containing corrosive crude oil at an elevated temperature with an effective, naphthenic acid decreasing amount of overbased detergent wherein the overbased detergent is selected from the group consisting of calcium sulfonates and phenates to produce a treated crude oil having a reduced naphthenic acid content.

2. The method of claim 1 wherein the oil is an acidic whole crude oil.

3. The method of claim 1 wherein the oil is an acidic crude fraction.

4. The method of claim 1 wherein the amount of overbased detergent is from 1:1 to 10:1 calcium to acidic functionality in the starting crude oil.

5. The method of claim 1 wherein the amount of overbased detergent is from 0.025:1 to 10:1 moles of calcium to acidic functionality in the starting crude oil.

6. The method of claim 1 wherein the amount of overbased detergent is 0.25:1 to 10:1 moles of calcium to acidic f unctionality in the starting crude oil.

7. The method of claim 1 wherein the amount of overbased detergent is less than a stoichiometric amount of calcium to acidic fuzunctionality in the starting crude oil.

8. The method of claim 1 wherein the amount of overbased detergent is from 0.025:1 to 5:1 moles of calcium to acidicfunctionality in the starting crude oil.

9. The method of claim 1 wherein the overbased detergent is added in a ratio from about 0.5:1 to 5:1 moles of calcium to acid content of the starting crude oil.

10. The method according to claim 1, wherein the overbased detergent is partially carbonated.

11. The method of claim 1 wherein the starting crude oil has a neutralization number of from about 0.5 to 10 mg KOH/g.

12. The method of claim 1 wherein the starting crude oil has a neutralization number of from about 0.2 to 10 mg KOH/g.

13. The method of claim 1 wherein the temperature is from about 20° C. to 200° C.

14. The method of claim 1 wherein the temperature is from about 100° C. to 170° C.

15. The method of claim 1 wherein the contacting produces a treated crude oil containing a carboxylate salts of naphthenic acids.

16. The method of claim 1 wherein the reduction in acidity of the treated crude oil is produced in the substantial absence of emulsion formation.

* * * * *